US007669819B2

(12) United States Patent
Meyers

(10) Patent No.: US 7,669,819 B2
(45) Date of Patent: Mar. 2, 2010

(54) ADJUSTABLE OFFICE PANEL HANGER SYSTEM

(76) Inventor: Steven D. Meyers, 105 Nelson Pkwy., Cherry Valley, IL (US) 61016

( * ) Notice: Subject to any disclaimer, the term of this patent is extended or adjusted under 35 U.S.C. 154(b) by 0 days.

(21) Appl. No.: 12/074,506

(22) Filed: Mar. 4, 2008

(65) Prior Publication Data

US 2009/0224118 A1 Sep. 10, 2009

(51) Int. Cl.
*A47G 29/00* (2006.01)

(52) U.S. Cl. ..... 248/215; 248/302; 211/119.004

(58) Field of Classification Search ..... 248/215, 248/302–304; 47/67; 211/113, 118, 85.15, 211/85.23, 119.003, 119, 119.004, 106, 106.01
See application file for complete search history.

(56) References Cited

U.S. PATENT DOCUMENTS

| | | | | | |
|---|---|---|---|---|---|
| 384,293 | A | * | 6/1888 | Snedden | 24/551 |
| 1,728,613 | A | * | 9/1929 | Jones | 248/302 |
| 2,929,886 | A | * | 3/1960 | Marback | 349/450 |
| 3,220,682 | A | * | 11/1965 | Hannon | 248/211 |
| 3,239,180 | A | * | 3/1966 | Bachmann | 248/210 |
| 3,332,653 | A | * | 7/1967 | Hoelzel | 248/210 |
| 4,138,019 | A | | 2/1979 | Smith | |
| D274,037 | S | | 5/1984 | Crim et al. | |
| D275,917 | S | | 10/1984 | Einhorn | |
| 4,524,542 | A | * | 6/1985 | Elliott | 47/67 |
| D304,545 | S | | 11/1989 | Hurrelbrink | |
| 4,918,789 | A | * | 4/1990 | Chen et al. | 24/67.9 |
| D312,961 | S | | 12/1990 | Evenson | |
| 5,009,380 | A | * | 4/1991 | Fee | 248/214 |
| 5,067,205 | A | * | 11/1991 | Chen et al. | 24/67.9 |
| D326,021 | S | | 5/1992 | Evenson | |
| D336,730 | S | | 6/1993 | Hofman | |
| D342,889 | S | | 1/1994 | Adams | |
| 5,368,267 | A | | 11/1994 | Howard | |
| 5,413,297 | A | | 5/1995 | Adams | |
| 5,711,502 | A | * | 1/1998 | Emalfarb et al. | 248/302 |
| 5,738,319 | A | | 4/1998 | Grassi | |
| 6,375,141 | B1 | * | 4/2002 | Kettlestrings | 248/303 |
| D465,724 | S | | 11/2002 | Goodman | |
| 6,715,526 | B1 | | 4/2004 | Brownfield et al. | |
| 7,207,088 | B2 | | 4/2007 | Adams et al. | |
| 7,234,671 | B2 | | 6/2007 | Avinger et al. | |
| 7,275,728 | B1 | * | 10/2007 | Branson | 248/302 |
| 2002/0104937 | A1 | | 8/2002 | Avinger | |
| 2003/0173483 | A1 | | 9/2003 | Yeh | |
| 2007/0205346 | A1 | | 9/2007 | Jackson et al. | |

* cited by examiner

*Primary Examiner*—Korie H. Chan
(74) *Attorney, Agent, or Firm*—Leydig, Voit & Mayer Ltd.

(57) ABSTRACT

A hanger system adapted to be positioned in adjustable, spanning relation across an upper surface of a wall panel structure with leg members extending generally downwardly in substantially adjacent relation to outwardly projecting faces of the wall panel structure. At least one of the leg members is adapted to operatively support personal and/or business articles in hanging relation across a face of the wall panel structure.

19 Claims, 6 Drawing Sheets

ADJUSTABLE OFFICE PANEL HANGER SYSTEM

TECHNICAL FIELD

This patent disclosure relates generally to hanger systems and, more particularly, to adjustable hanger systems adapted for disposition in overhanging relation to upper boundary edges of modular office panels or other support wall structures to permit the hanging of objects in substantially adjacent relation to the support wall faces at positions below the upper boundary edges.

BACKGROUND

In office environments it is common to find workspace partitions in the form of modular wall panels. These panels are typically not designed to run from floor to ceiling but rather are free-standing and are assembled as modules to enclose or partially enclose a workspace thereby forming a so-called "cubicle" workspace. Wall panel systems provide a substantial benefit in the workplace environment by affording the ability to rapidly reconfigure a workspace with minimum disruption and with no need to move walls. Thus, such systems have gained wide acceptance.

Many forms of wall panel systems are known, having various constructions and different aesthetic characteristics. By way of example only, one common form of office panel is a self-supporting substantially planar construction formed from a metal frame surrounding a core of relatively lightweight material such as fiberboard or fiberglass, having sound deadening capabilities. Often, these panels are covered with pieces of fabric supplied in patterns which are meant to enhance the particular decor of the office environment. By way of example only, and not limitation, illustrative wall panel constructions which incorporate outer fabric constructions are disclosed in U.S. Pat. No. 5,086,606 in Finses and U.S. Pat. No. 5,689,924 to Mason, both of which are incorporated by reference as if fully set forth herein.

Due to the physical construction of typical office panel systems, it is generally impractical to mount personal or work-related articles across the panel faces. In this regard, typical mounting options such as nails, screws, tacks and the like have the disadvantage of puncturing the decorative covering and inner core materials. Such puncturing may substantially degrade the appearance of the panel, thereby reducing the ability to reuse the panel in a different configuration at a later time. High levels of perforation also have the possibility of reducing sound insulation properties. Likewise, non-perforating adhesive techniques such as glue, tape and the like may also damage the panel surface when the adhered items are removed. In addition, such adhesive techniques may provide relatively limited holding strength. Thus, such adhesive techniques may be of limited use in supporting larger items.

SUMMARY

The present invention offers advantages and alternatives over the prior practices by providing a hanger system adapted to be positioned in adjustable, spanning relation across an upper surface of a wall panel structure with leg members extending generally downwardly in substantially adjacent relation to outwardly projecting faces of the wall panel structure. At least one of the leg members is adapted to operatively support personal and/or business articles in hanging relation across a face of the wall panel structure.

In accordance with one aspect, a hanger adapted for disposition in overhanging relation to a cubicle wall panel structure is provided. The hanger includes a deformable base adapted for disposition atop the cubicle wall panel structure. The base includes a deformable member extending in a substantially sinusoidal pattern at least partially along a distance between a first end and a second end of the base. A first leg element extends downwardly from a position adjacent the first end and a second leg element extending downwardly from a position adjacent the second end. The first leg element includes at least a first laterally projecting support element adapted to engage a hanging article at a position outboard from the wall face. The distance between the first end of the base and the second end of the base is adjustable by manual compression and/or expansion of the substantially sinusoidal pattern.

Other advantages and aspects of the present invention will become apparent through reference to the following detailed description and/or through practice of the invention.

BRIEF DESCRIPTION OF THE DRAWINGS

The following drawings which are incorporated in and which constitute a part of this specification illustrate several exemplary embodiments and constructions consistent with this disclosure and, together with the general description given above, and the detailed description set forth below, serve to explain the principles of the invention wherein.

While the invention has been generally described above and will hereinafter be described in connection with certain potentially preferred embodiments and procedures, it is to be understood that in no event is the invention to be limited to such illustrated and described embodiments and procedures. On the contrary, it is intended that the present invention shall extend to all alternatives and modifications to the illustrated and described embodiments and procedures as may embrace the broad principles of this invention within the true spirit and scope thereof.

DETAILED DESCRIPTION

As will be described further hereinafter, an improved hanger system for use in conjunction with office panel wall structures is provided. The improved hanger system is adapted for support across an upper surface of the office panel wall structure. Downwardly extending legs are adapted to provide hanging support to personal and/or business articles.

Figure 1:
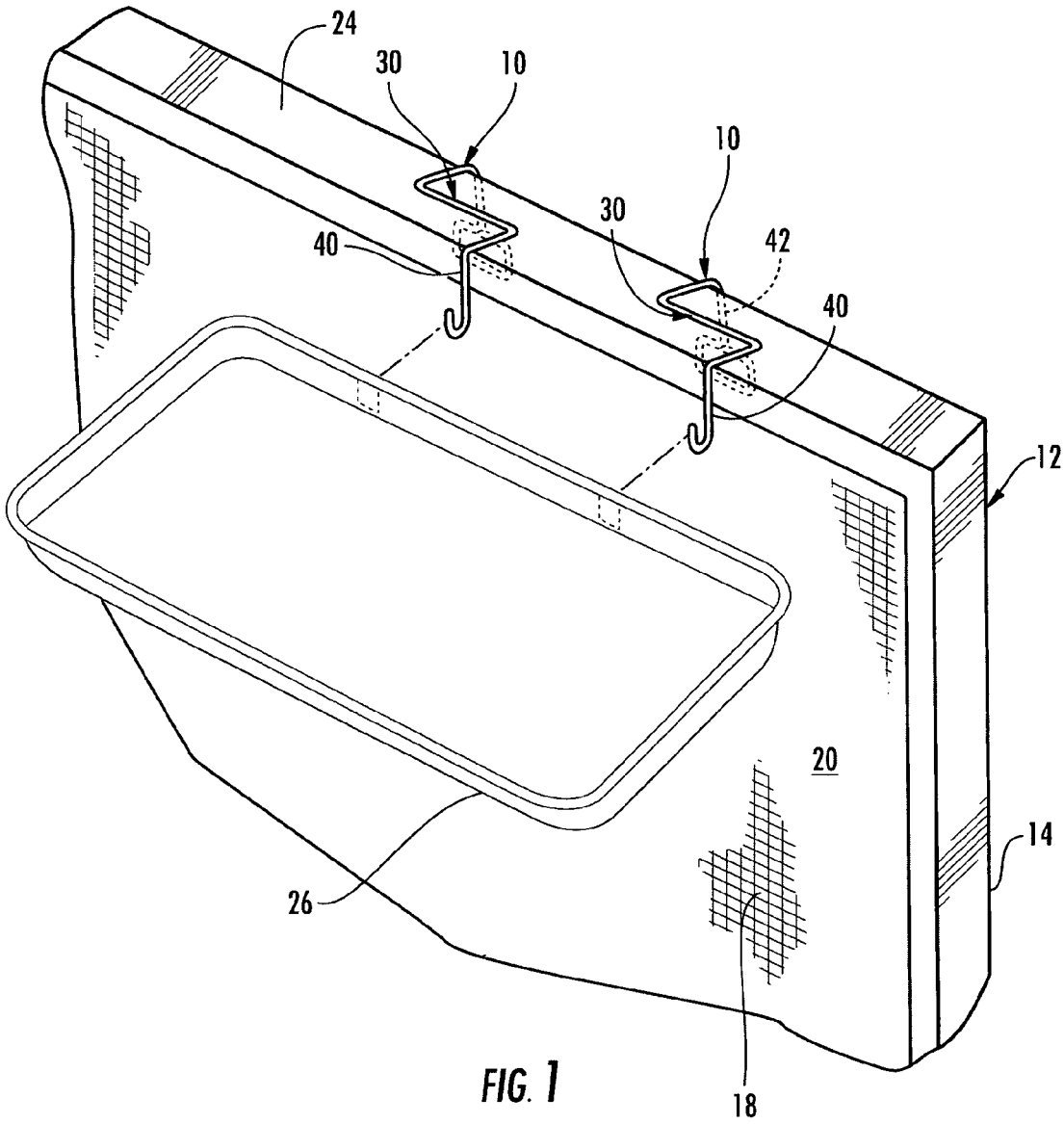
FIG. 1 is a perspective view illustrating an office cubicle wall panel structure with a pair of exemplary wall panel hangers supported across an upper surface of the wall panel structure and positioned to engage a mountable article.
Figure 2:
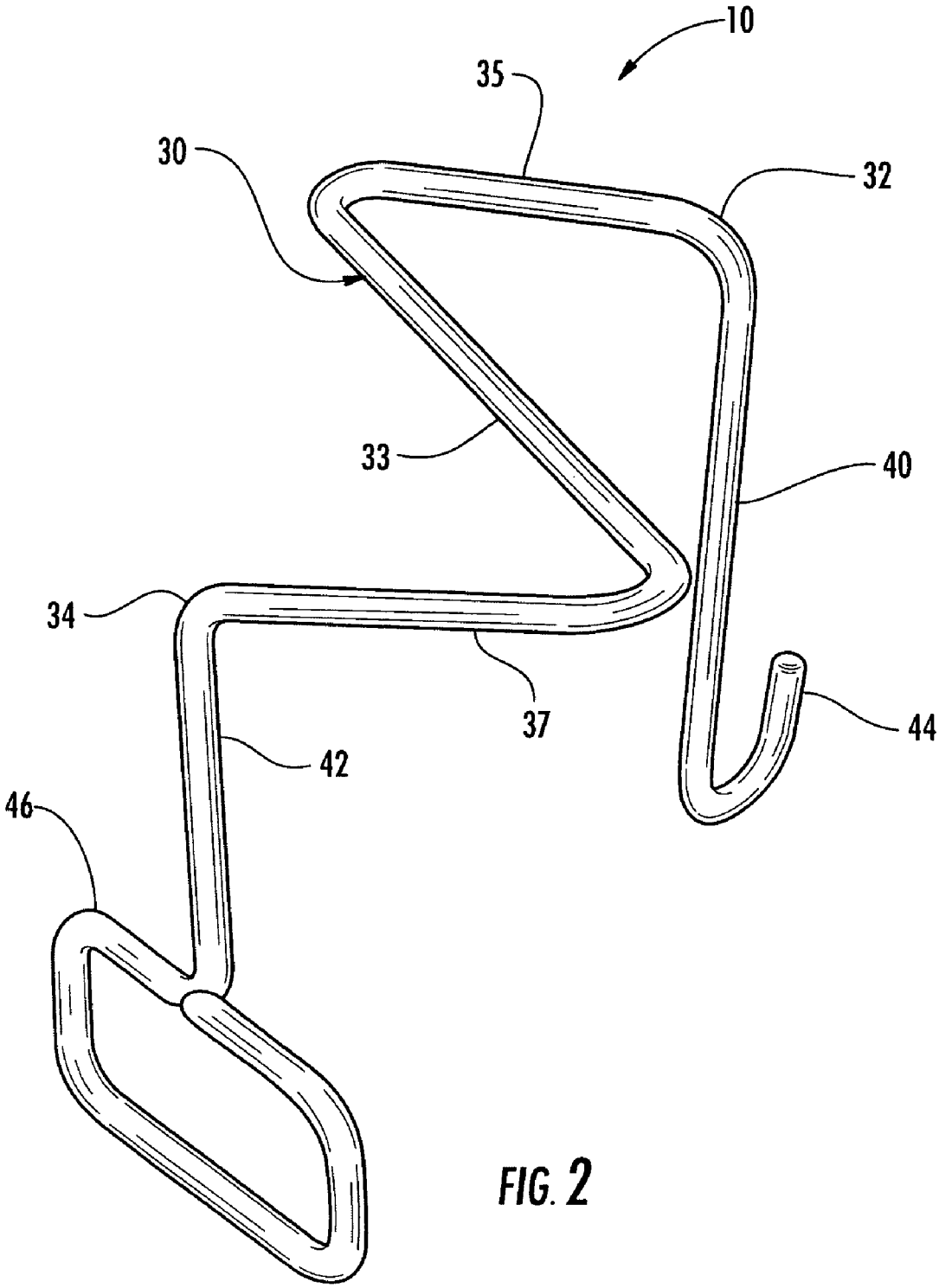
FIG. 2 is a view illustrating an exemplary wall panel hanger having an embodiment as illustrated in FIG. 1.
Figure 3:
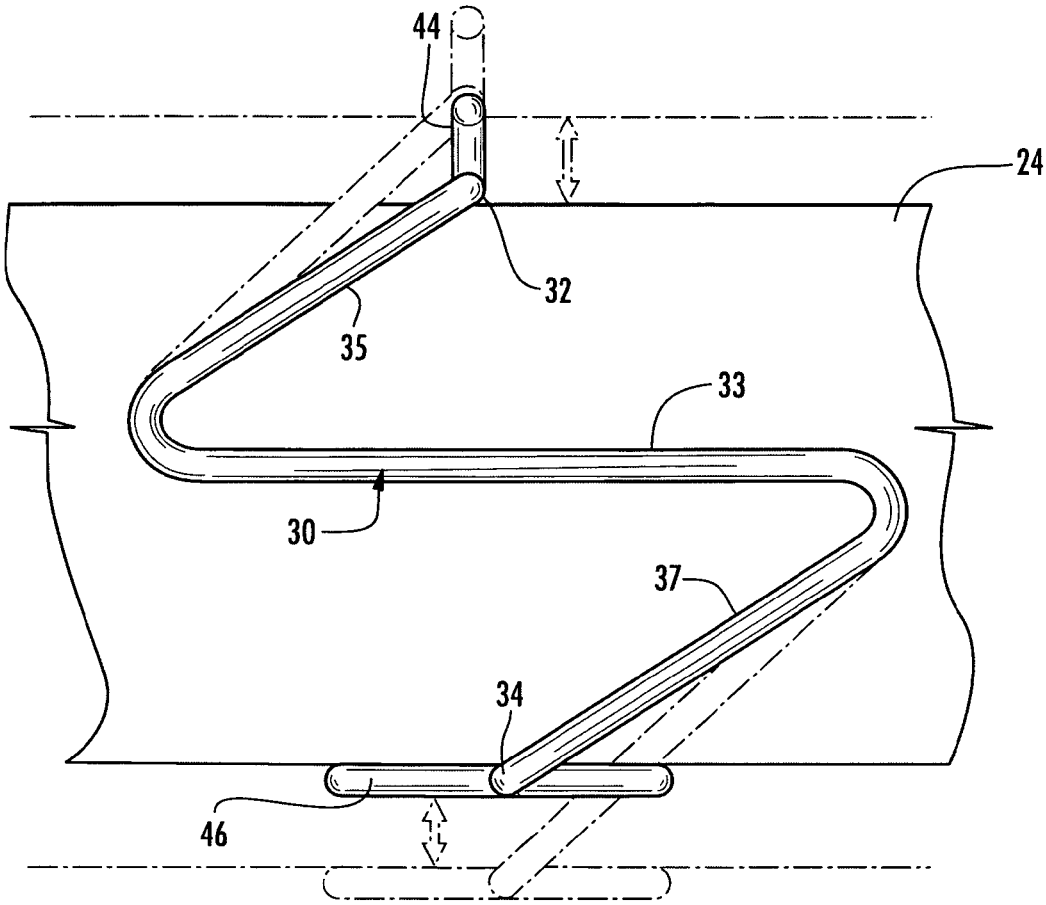
FIG. 3 is an elevation view of the exemplary wall panel hanger of FIG. 2 illustrating the width adjustment of the wall panel hanger relative to a wall panel structure.

Reference will now be made to the drawings, wherein to the extent possible, like elements are designated by like reference numerals throughout the various views. Referring jointly to FIGS. 1-3, a pair of wall panel hangers 10 is illustrated disposed in overlying relation to a wall panel structure 12 such as a modular cubicle wall or the like. In the illustrated arrangement, the wall panel structure 12 includes a metal support frame 14 surrounding a core structure of sound-insulating fiberboard or the like. A fabric 18 or other suitable material covers the outer surface of the core structure to define a show face 20. This arrangement may be duplicated on the opposing face of the wall panel structure. Of course, the illustrated construction of the wall panel structure 12 is exemplary only, and any other wall panel construction may likewise be utilized if desired. In addition, while only a single wall panel structure 12 is illustrated, it is also contemplated that two or more such structures may be arranged in juxtaposed, overlapping relation as will be common in many cubicle arrangements with the wall panel hangers spanning such juxtaposed wall panel structures.

Regardless of the construction or arrangement of the wall panel structure 12, the exemplary wall panel hangers 10 illustrated in FIG. 1 are adapted to span an upper boundary surface 24 disposed between opposing faces of the wall panel structure 12. The exemplary wall panel hangers 10 illustrated in FIG. 1 are also adapted to be manually adjustable to span upper boundary surfaces 24 of different widths as may be encountered. Thus, the exemplary wall panel hangers 10 may be snuggly fit over the wall panel structure 12 with the wall panel structure 12 providing underlying support. As will be described further hereinafter, the exemplary wall panel hangers 10 are adapted to engage and support hanging articles 26 such as business articles, clothing, pictures, calendars and the like in adjacent relation to show face 20. As will be appreciated, the wall panel hangers 10 may be used individually or in combination depending on the nature of the hanging article.

The width adjustment and hanging support features of the exemplary wall panel hangers 10 may be understood through joint reference to FIGS. 1-3. As shown, the exemplary wall panel hanger 10 includes a deformable base 30 adapted to rest atop the upper boundary surface 24 of the wall panel structure 12. The deformable base 30 may be formed from an elongate member such as metal rod stock or the like which has undergone bending or other plastic deformation treatment to assume and retain a substantially sinusoidal pattern. By way of example only, and not limitation, one suitable material for construction on the deformable base may be circular cold rolled mild steel stock having a diameter of about ⅛ to about 3⁄16 inches which has been bent into a sinusoidal pattern using a torch or other localized heating techniques to facilitate bending. If desired, such material may thereafter be heated to relieve stresses introduced during the bending process. Of course, higher and lower diameter stock may also be utilized if desired. Deformable materials other than steel may also be utilized. By way of example only, such other materials may include aluminum, copper and the like. Likewise, other configuration techniques may also be used to obtain the final desired arrangement. By way of example only, such alternative configuration techniques may include the use of a programmable bender, original casting to the desired shape, metal powder compression and sintering to the desired shape and other suitable configuration techniques as may be available.

In the exemplary construction, the sinusoidal pattern of deformable base 30 resides in a plane adapted to be positioned substantially parallel to the upper boundary surface 24 of the wall panel structure 12 when the hanger 10 is in an operative position as shown in FIG. 1. The exemplary sinusoidal pattern of deformable base 30 runs between a first end 32 and a second end 34. As best seen in FIG. 3, the exemplary deformable base 30 includes a central member 33 extending generally between a first angled arm 35 and a second angled arm 37. Central member 33, first angled arm 35 and second angled arm 37 may all reside within a common plane. In the illustrated construction, the first angled arm 35 extends generally between central member 33 and first end 32. The second angled arm 37 extends generally between central member 33 and second end 34. In the exemplary construction, the first angled arm 35 and the second angled arm 37 may form substantially equivalent but opposite angles relative to central member 33 such that the first angled arm 35 and the second angled arm 37 are disposed in generally parallel relation to one another. However, other angled relationships may likewise be used if desired. In the illustrated arrangement, the first end 32 and the second end 34 may be disposed in generally opposed and aligned relation to one another on opposite sides of central member 33. Of course, various combinations of angles and lengths may likewise be used if desired.

As best seen in FIG. 2, a first leg element 40 extends generally downwardly from a position adjacent the first end 32. A second leg element 42 extends generally downwardly from a position adjacent the second end 34. According to one contemplated practice, the first leg element 40 and/or the second leg element 42 may be integral with the deformable base 30 such that the first leg element 40 and/or the second leg element 42 may be formed with the deformable base 30 from a singular elongate member which is configured by bending or other suitable practices to a desired geometry. However, it is likewise contemplated that individual portions of the wall panel hanger 10 may be formed independently and thereafter joined by suitable techniques such as welding, adhesive bonding or the like as may be desired. It is also contemplated that wall panel hanger 10 may be at least partially covered with a protective coating of plastic or other material to avoid damage to the hanger and/or to the wall panel structure 12.

As best seen through joint reference to FIGS. 2 and 3, the deformable base 30 is adjustable to conform to the width of an underlying wall panel structure by the manual application of tensioning or compressing forces. Specifically, as shown in FIG. 3, the operative width of the deformable base 30 may be reduced from an initial state (shown in phantom lines) to a contracted state (shown in solid lines) by the application of a compressing force, thereby establishing a snug fit with the underlying wall panel structure. If desired, the operative width of the deformable base 30 may also be expanded from the initial state (shown in phantom lines) to an expanded state (not shown), thereby establishing a snug fit with the underlying wall panel structure of enhanced width such as may be present if two or more wall panel structures overlap. In any event, the expansion or compression of the deformable base is substantially reversible by simply applying an opposite force. As will be recognized, the adjustment is carried out primarily through manipulation of the angles between central member 33 and the angled arms 35, 37. Thus, the alignment of the first leg element 40 and the second leg element 42 may remain substantially intact. Likewise, central member 33 may undergo little if any adjustment, and remains in position across upper boundary surfaces 24.

In the exemplary arrangement, the expansion and/or contraction does not substantially alter the plane of the deformable base. That is, the expansion and/or contraction is carried out within the plane. Thus, the wall panel hanger 10 maintains a relatively low profile across the upper boundary surface 24. Once a desired operative width is achieved, the angled arms 35, 37 in combination with central member 33 provide a stable base which substantially resists rocking motion. The snug fit is maintained by the downwardly extending leg elements 40, 42. As will be appreciated, the sinusoidal pattern of the deformable base need not be in the form of a mathematically precise sine or cosine function. Rather the term "sinusoidal pattern" is meant to embrace any expansible or contractible pattern having a general wave-like configuration. Moreover, the first end 32 and the second end 34 need not be perfectly aligned. That is, a line running between the first end 32 and the second end 34 need not intersect central member 33 at a right angle. Rather, it is contemplated that any generally opposed relation may be utilized.

With the wall panel hanger 10 clamped in position over upper boundary 24, a stable support is provided for carrying out the hanging function. In the illustrated construction, the first leg element 40 includes a proximal portion engaging the deformable base 30 and a distal portion defining a lateral extension element 44. While the lateral extension element 44 is illustrated in the form of a simple hook structure, any number of other structures may likewise be utilized if desired. By way of example only, such other structures may include other hooking configurations, platforms, rings and the like as may occur to those of skill in the art. Moreover, while only a single lateral extension element 44 is illustrated, it is also contemplated that multiple extension elements of similar or dissimilar configuration may be utilized at various positions along the first leg element. Regardless of the configuration, the lateral extension element 44 preferably extends away from the first leg element to an operative position spaced apart from the show surface 20 of wall panel structure 12 to facilitate engagement with hanging articles. In this regard, it is to be understood that while the lateral extension element 44 is illustrated as extending outwardly at a substantially right angle to show face 20, it is likewise contemplated that other angled arrangements which provide spacing between the support element 44 and the show surface 20 also may be utilized if desired.

As previously noted, the second leg element 42 extends generally downwardly from a position adjacent the second end 34. In the illustrated construction, the second leg element 42 includes a proximal portion engaging the deformable base 30 and a distal portion defining a force distribution anchor 46 of enhanced diameter. In the illustrated construction, the force distribution anchor 46 is substantially planar and is adapted to reside against an outer face of wall panel structure 12. The force distribution anchor 46 may enhance the stability of the wall panel hanger 10 by providing added weight to the side opposite support element 44. The force distribution anchor 46 may also be used as an attachment for hanging articles if desired.

Figure 4:
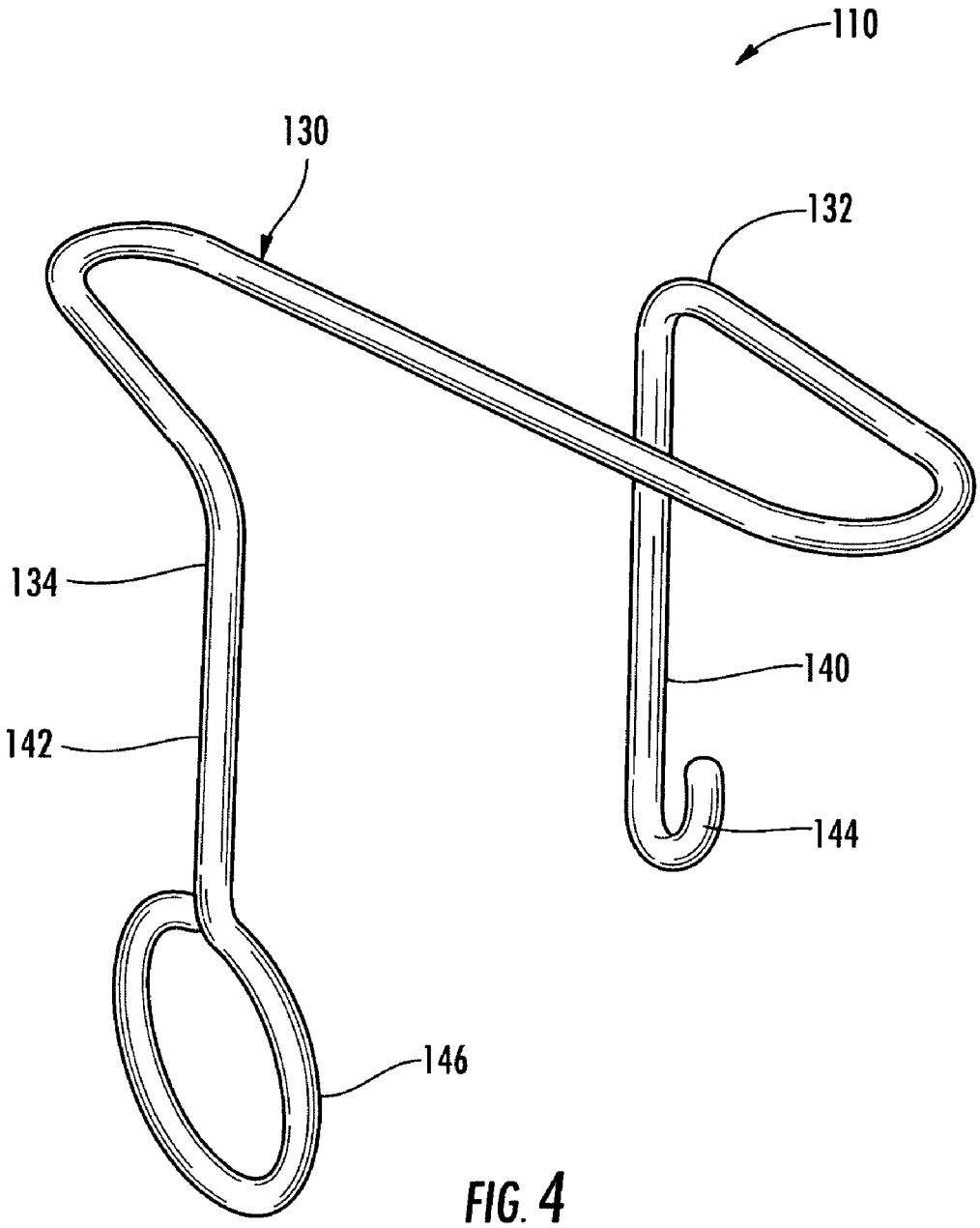
FIG. 4 is a view similar to FIG. 2, illustrating another embodiment of a wall panel hanger.

While the force distribution anchor 46 is illustrated in FIG. 2 as having a substantially rectangular configuration, it is also contemplated that any number of other configurations may be utilized if desired. By way of example only, FIG. 4 illustrates an alternative construction for a wall panel hanger 110 wherein elements corresponding to those previously described are designated by like reference numerals increased by 100. As shown, in this construction the force distribution anchor 146 is substantially round. Of course, any number of other geometries may also be utilized.

Figure 5:
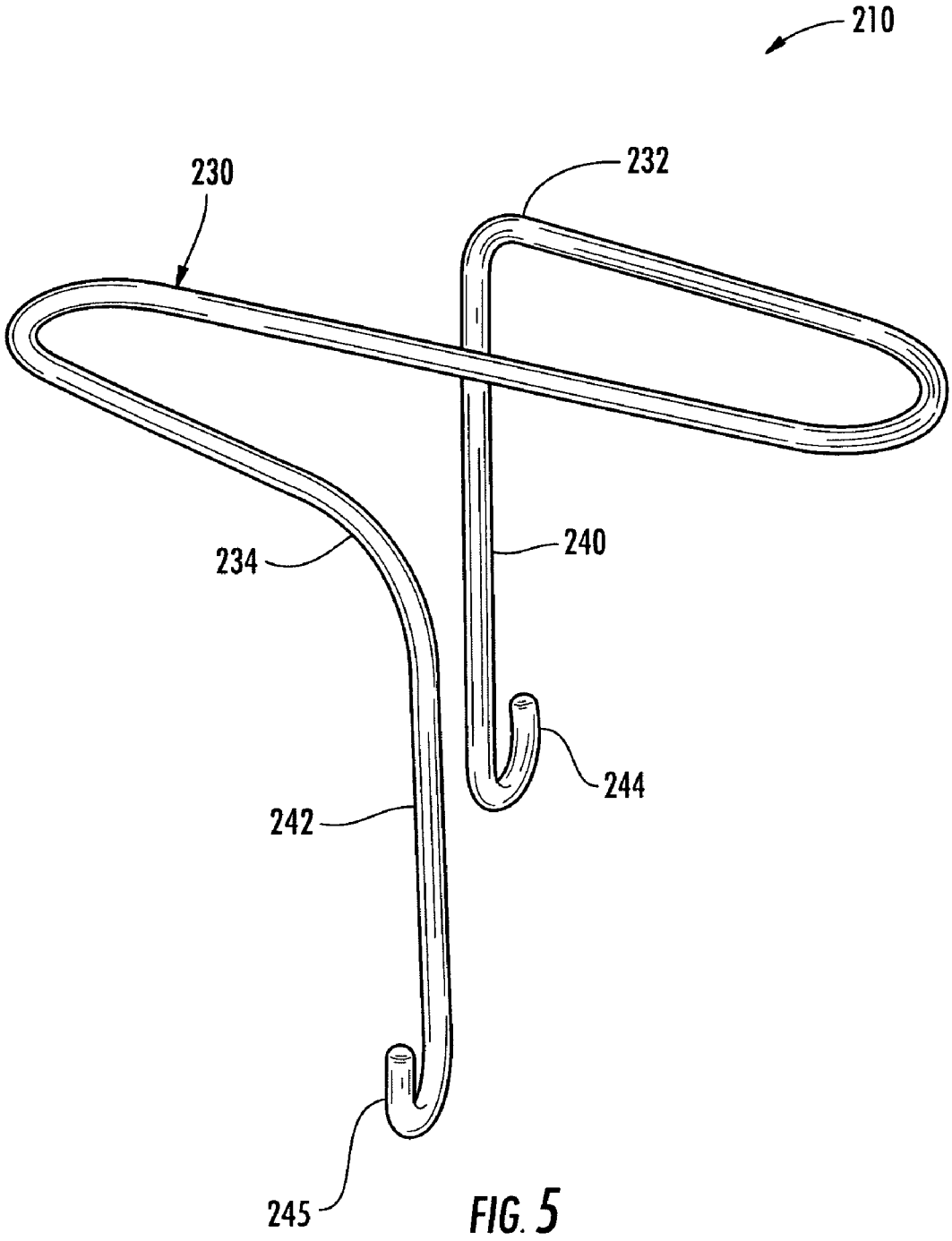
FIG. 5 is a view similar to FIG. 2, illustrating another embodiment of a wall panel hanger.

It is also contemplated that the force distribution anchor may be eliminated entirely if desired. By way of example only, FIG. 5 illustrates an alternative construction for a wall panel hanger 210 wherein elements corresponding to those previously described are designated by like reference numerals within a 200 series. As may be seen, in this construction a complimentary lateral extension element 245 such as a hook or other structure is positioned at the distal end of the second leg element 242. Thus, articles may hang from both sides of wall panel hanger 210.

Figure 6:
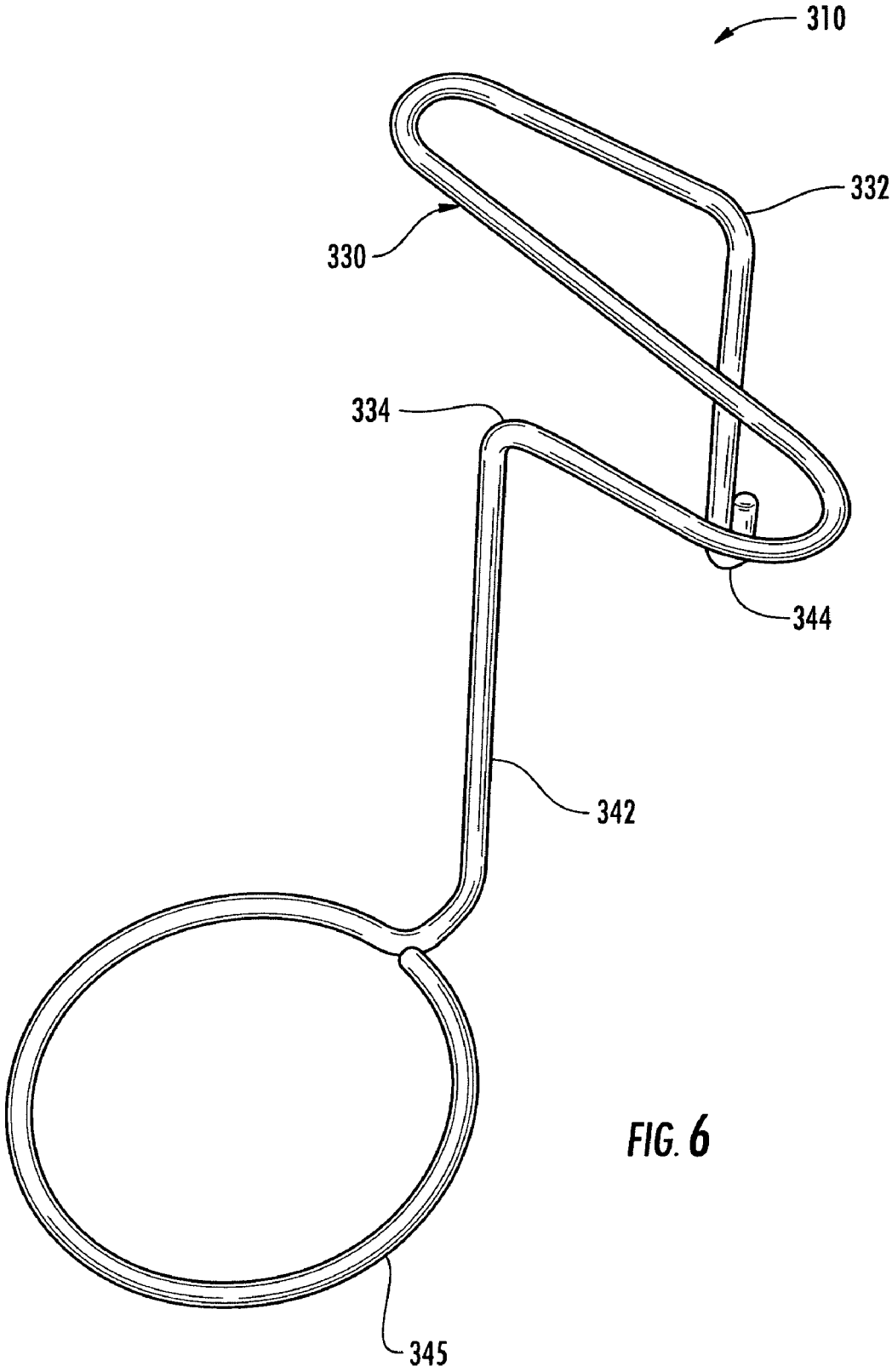
FIG. 6 is a view similar to FIG. 2, illustrating another embodiment of a wall panel hanger.

In the event that lateral extension elements are utilized to provide hanging support at both sides of a wall panel hanger, there is no need for such lateral extension elements to be identical. To the contrary, in many environments of use it may be desirable to use different constructions at opposing sides of the wall panel hanger. By way of example only, and not limitation, FIG. 6 illustrates an alternative construction for a wall panel hanger 310 wherein elements corresponding to those previously described are designated by like reference numerals within a 300 series. As may be seen, in this construction a complimentary lateral extension element 345 in the form of a hoop extends laterally away from the second leg element 342. Such a structure may be used to hold a cup, a potted plant or the like as may be desired.

Of course, it is contemplated that any number of other structures and combinations may likewise be utilized. In this regard, it will be appreciated that the foregoing description provides examples of the disclosed system and technique. However, it is contemplated that other implementations of the disclosure may differ in detail from the foregoing examples. All references to examples herein are intended to reference the particular example being discussed at that point and are not intended to imply any limitation as to the scope of the disclosure or claims more generally. All language of distinction and disparagement with respect to certain features is intended to indicate a lack of preference for those features, but not to exclude such from the scope of the claims entirely unless otherwise indicated. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure contemplates the inclusion of all modifications and equivalents of the subject matter recited in the appended claims as permitted by applicable law. Moreover, any combination of the above-described elements in all possible variations thereof is contemplated unless otherwise indicated herein or otherwise clearly contradicted by context.

What is claimed is:

1. A hanger system adapted for disposition in overhanging relation to a wall panel structure, the hanger system comprising: a deformable base adapted for disposition atop the wall panel structure, the deformable base comprising a deformable elongate member extending in a substantially sinusoidal pattern residing in a base plane at least partially along a distance between a first end and a second end of the base; a first leg element extending downwardly from a position adjacent the first end; and a second leg element extending downwardly from a position adjacent the second end, wherein the first leg element includes a first proximal leg portion extending to a first distal leg portion, the first distal leg portion defining a first laterally projecting support element adapted to project outwardly away from a first face of the wall panel structure, wherein the deformable base defines a spacer holding all portions of the first leg element in spaced-apart relation from all portions of the second leg element such that the first leg element and the second leg element are held in non-crossing relation at all positions below the deformable base, the distance between the first end of the base and the second end of the deformable base being adjustable within said plane by at least one of manual compression and manual expansion of the substantially sinusoidal pattern while maintaining separation between the first leg element and the second leg element at all positions below the deformable base.

2. The hanger system as recited in claim 1, wherein the first leg element is integral with the deformable base.

3. The hanger system as recited in claim 1, wherein the second leg element is integral with the deformable base.

4. The hanger system as recited in claim 1, wherein the first leg element is integral with the deformable base and wherein the second leg element is integral with the deformable base.

5. The hanger system as recited in claim 4, wherein each of the deformable base, the first leg element and the second leg element are formed from metal.

6. The hanger system as recited in claim 5, wherein each of the deformable base, the first leg element and the second leg element are substantially circular in cross section.

7. The hanger system as recited in claim 6, wherein said circular cross section has a diameter of about ⅛ to about 3/16 inches.

8. The hanger system as recited in claim 7, wherein said metal is selected from the group consisting of steel, copper and aluminum.

9. The hanger system as recited in claim 1, wherein said first laterally projecting support element comprises a hook.

10. The hanger system as recited in claim 1, wherein the second leg element includes at least a second laterally projecting support element adapted to project to a position spaced away from a second face of the wall panel structure.

11. The hanger system as recited in claim 10, wherein said at least a second laterally projecting support element comprises a hook.

12. The hanger system as recited in claim 10, wherein said at least a second laterally projecting support element comprises a ring.

13. A hanger system adapted for disposition in overhanging relation to a wall panel structure, the hanger system comprising: a single deformable elongate metal member of substantially circular cross section configured to define a deformable base adapted for disposition atop the wall panel structure, the deformable base including a portion extending in a substantially sinusoidal pattern residing in a base plane at least partially along a distance between a first end and a second end of the deformable base; said single deformable elongate metallic member further configured to define a first leg element integral with the deformable base and extending downwardly from a position adjacent the first end; said single deformable elongate metallic member further configured to define a second leg element integral with the deformable base and extending downwardly from a position adjacent the second end, wherein the first leg element includes at least a first laterally projecting support element adapted to project outwardly from a first face of the wall panel structure, wherein the deformable base defines a spacer holding all portions of the first leg element in spaced-apart relation from all portions of the second leg element such that the first leg element and the second leg element are held in non-crossing relation at all positions below the deformable base, the distance between the first end of the base and the second end of the base being adjustable within said plane by at least one of manual compression and manual expansion of the substantially sinusoidal pattern while maintaining separation between the first leg element and the second leg element at all positions below the deformable base.

14. The hanger system as recited in claim 13, wherein said circular cross section has a diameter of about ⅛ to about 3/16 inches.

15. The hanger system as recited in claim 13, wherein said metal is selected from the group consisting of steel, copper and aluminum.

16. The hanger system as recited in claim 13, wherein said at least a first laterally projecting support element comprises a hook.

17. The hanger system as recited in claim 13, wherein the second leg element includes at least a second laterally projecting support element adapted to project to a position spaced away from a second face of the wall panel structure.

18. The hanger system as recited in claim 17, wherein said at least a second laterally projecting support element comprises a hook.

19. The hanger system as recited in claim 17, wherein said at least a second laterally projecting support element comprises a ring.

* * * * *